US005641215A

United States Patent [19]

Pochet

[11] Patent Number: 5,641,215

[45] Date of Patent: Jun. 24, 1997

[54] MULTI-CABINET ASSEMBLY

[75] Inventor: Luc Pochet, Brussels, Belgium

[73] Assignee: Hans Skeppner, Brussels, Belgium

[21] Appl. No.: 407,310

[22] Filed: Mar. 20, 1995

[51] Int. Cl.[6] ..... E06B 5/00

[52] U.S. Cl. ..... 312/109; 49/15; 312/218; 312/222; 312/107.5

[58] Field of Search ..... 312/215, 218, 312/222, 107.5, 109; 49/15

[56] References Cited

U.S. PATENT DOCUMENTS

| | | | |
|---|---|---|---|
| 2,259,722 | 10/1941 | Bales | 312/109 |
| 3,575,480 | 4/1971 | Peisker | 312/218 |
| 4,298,236 | 11/1981 | Laroche | 312/215 |
| 4,303,288 | 12/1981 | Aschinger | 312/215 |
| 4,416,413 | 11/1983 | Chester | 312/215 X |
| 4,533,165 | 8/1985 | Edelman | 312/215 X |
| 4,770,476 | 9/1988 | Lakso | 312/215 X |
| 4,955,672 | 9/1990 | Pham | 312/107.5 |
| 5,303,994 | 4/1994 | Elsholz | 312/215 X |
| 5,333,949 | 8/1994 | McGregor | 312/222 X |

*Primary Examiner*—Peter M. Cuomo
*Assistant Examiner*—Stephen Vu
*Attorney, Agent, or Firm*—Townsend and Townsend and Crew LLP

[57] ABSTRACT

A multi-cabinet assembly comprises single cabinets which are arranged next to one another. The single cabinets include at least one master cabinet and one slave cabinet. All of the cabinets have a door. The multi-cabinet assembly further comprises an interlock system for the slave doors which includes at least one horizontally movable interconnecting rod, a locking means connected to the interconnecting rod for being displaced between an engagement position and a release position, and a counterlocking means for engaging said locking means in a locked position of the slave door in case said locking means is arranged in engagement position. The counterlocking means is arranged at the slave door and the interconnecting rod is movably connected with the master door for displacing the locking means. For securing the locking condition of the slave doors and to provide a simple construction of the interlock system said locking means essentially extends in vertical direction and said counterlocking means is locking hook pivotable about a vertical axis and spring-loaded in direction to the locking means for mutual engagement.

29 Claims, 4 Drawing Sheets

MULTI-CABINET ASSEMBLY

BACKGROUND OF THE INVENTION

1. Field of the Invention

This invention relates to a multi-cabinet assembly and more particularly to an interlocking system for locking and unlocking slave doors of slave cabinets arranged adjacent to a master cabinet.

2. Description of the Related Art

Multi-cabinet assemblies comprise a number of single cabinets which are arranged next to one another to form a serial arrangement of cabinets. One of the cabinets which is normally arranged at one end of the multi-cabinet assembly is a so-called master cabinet with a corresponding master door whereby the other cabinets are so-called slave cabinets with corresponding slave doors. Such an arrangement of master and slave cabinets is for example used for housing electric and electronic equipment for controlling a stock of engines, a production line, etc.

To prevent an opening of the slave doors without switching-off a power supply for the electric and electronic equipment inside the cabinets an interlocking system is provided. By this interlocking system opening of the slave doors is only possible in case the master door of the master cabinet is opened. The interlocking system comprises one or more interconnecting rods which are usually slidably supported at an upper door frame of the cabinets. One of the interconnecting rods is movably connected to the master door. When the master door is opened it pushes a first interconnecting rod whereby this movement is transferred to all the other interconnecting rods connected with one another and with the first interconnecting rod.

Instead of a plurality of interconnecting rods it is also possible to use only one interconnecting rod movably connected at one end to the master door and extending along all slave cabinets.

The interlock system further comprises a locking means and a counterlocking means whereby the locking means is arranged at and movable with the interconnecting rod and the counterlocking means is arranged at each slave door. When all doors are closed the interconnecting rod is in such a position that the locking means are in an engagement position in which locking means and counterlocking means are in engagement for locking the slave doors. By opening the master door the interconnecting rod or interconnecting rods are pushed to place the locking means in a release position in which the locking means and the counterlocking means can be separated and the slave doors can be opened by corresponding door handles.

After the master door is closed and all the locking means are back in engagement position the locking means and counterlocking means can again enter engagement by closing the slave doors.

A known multi-cabinet assembly uses a counterlocking means essentially extending in horizontal direction and parallel to the interconnecting rod. The counterlocking means has an L-shaped cross-section whereby one vertical L-shank is used for fixing the locking means at the slave door and whereby the horizontal L-shank has an upward tilted end portion for engagement with the locking means. This locking means is formed like a hook that is pivotable about a horizontal axis. This axis is fixed by a bracket to the interconnecting rod. The interconnecting rod is guided through that bracket and has a ramp-like engagement portion for lifting the hook in release position.

After the interconnecting rod is pushed back to engagement position the hook is pivoted upwards by the end portion of the horizontal L-shank when the slave door is closed and because of gravity the hook comes again in engagement with the locking means after the slave door is closed to lock this door.

The known multi-cabinet assembly sometimes provides the problem that the slave doors which are hinged on one side arc, due to a wrong leveling of the cabinets on an unleveled floor, a little bit distorted or lopsided so that a proper engagement of the locking means and counterlocking means is not secured as for example the upward tilted end portion of the horizontal L-shank of the counterlocking means is arranged too low for a proper engagement with the hook-like locking means. Therefore, even if the master door is closed and the interconnecting rod is in engagement position the corresponding slave door could be opened by operating its door handle.

SUMMARY OF THE INVENTION

In view of the above problem the purpose of the present invention is to provide a multi-cabinet assembly with an interlock system of simple construction whereby engagement of locking means and counterlocking means for locking the slave doors is secured independent from for example any misalignment or distortion of the slave door.

These goals are achieved by a multi-cabinet assembly with an interlock system comprising a locking means essentially extending in vertical direction and a counterlocking means formed as a locking hook which is pivotally supported about a vertical axis and which is spring-loaded in direction to the locking means for mutual engagement. Because of this arrangement of the locking means and the counterlocking means a proper engagement is always possible independent from any misalignments of the slave door. Moreover, the locking hook is spring-loaded in engagement direction to further secure a proper engagement of locking and counterlocking means.

As a locking means for the invention such an L-shaped counterlocking means as aforementioned may be used. However, this locking means has to be arranged vertically and not horizontally. A preferred embodiment uses a vertical drop-in pin for the locking means which pin may be easily engaged by the locking hook. The drop-in pin can directly be fixed to the interconnecting rod or can be supported by a mounting which is fixed to the interconnecting rod.

To bilaterally support the drop-in pin by said mounting it is of an essentially U-shaped cross-section with U-shanks extending in direction to the slave door. Preferably the U-shanks extend horizontally to form an upper and lower U-shank. Then, the locking hook comes into engagement with the drop-in pin above the upper U-shank below the lower U-shank or between the two U-shanks. The drop-in pin only has to have a corresponding length and has to extend above or below the corresponding shanks, respectively.

In order to fix the interconnecting rod with the mounting the interconnecting rod is fixed to a U-web connecting the upper and lower U-shank. Interconnecting rod and web may be fixed by screws or other fixtures.

In case more than one interconnecting rod is used, adjacent interconnecting rods may be fixed to opposite end portions of the mounting. One end of an interconnecting rod, which rod is movably connected with the master door, and one end of a further interconnecting rod, which extends to another slave cabinet, are fixed to the U-web. Again they may be fixed for example by screws and corresponding nuts.

To avoid any interference of the interconnecting rod with the locking hook in engagement or release position and to use mountings with U-shanks extending as little as possible in direction to the locking hook the ends of the interconnecting rods that are fixed to the U-web are spaced in horizontal direction whereby between these ends the drop-in pin is supported.

To adapt the interlocking system with respect to different slave doors or with respect to different positions of the locking hook these two bearings for the drop-in pin can be arrangement in both U-shanks. In this way the drop-in pin can be arranged in at least two different positions. Thus the system provides a total reversibility. Doors may be provided with left-hand or right-hand hinges; the master cabinet may be arranged on the left-hand or right-hand side of the slave cabinet. Normally, the different bearings are spaced from one another in sliding direction of the interconnecting rod. For simply supporting the drop-in pin each bearing comprises two bearing borings coaxially arranged in upper and lower U-shanks.

The drop-in pin can be fixed in the borings by riveting or in a preferred embodiment the drop-in pin is inserted in both bearing borings and comprises a head at its upper end which is supported by the upper U-shank. In this way the drop-in pin can easily be disassembled and for example inserted in the bearing borings of another bearing.

The length of the U-shanks may be further reduced by arranging an opening in the U-web for at least partially inserting the locking hook just before and during engaging the drop-in pin.

To support the interconnecting rod or rods and for supporting the locking means and counterlocking means the mounting for the drop-in pin can be movably supported in sliding direction by a slide device arranged at an upper frame member of each slave cabinet. Preferably the slide device is a simple slide guide of an essentially U-shaped cross-section that can be releasably fixed to said upper frame member. For guiding the mounting the upper and lower U-shanks of the slide guide at least partially embrace the U-shanks of the mounting.

To have more freedom for fixing the interconnecting rod to the mounting and to securely support the mounting, the U-web of the mounting is spaced from the U-web of the slide guide and the lower U-shank of the slide guide extends further than the lower U-shank of the mounting. Furthermore, the upper U-shank of the slide guide can be formed by two shank sections arranged at ends of the U-web to allow free sliding of the drop-in pin in case it extends above the upper U-shank of the mounting. Moreover, a vertical mounting plate can extend from the U-web of the slide guide between the two shank sections which can be used for fixing the slide guide at the upper frame member.

For guiding the drop-in pin and for corresponding guiding the mounting a preferred embodiment of the slide guide comprises a guide slot in the lower U-shank.

For easily fixing the locking hook to the slave door a support bracket is provided, which can be releasably fixed to an inner surface of the slave door and which pivotally supports the locking hook.

The locking hook can be manufactured from flat sheet metal whereby the locking hook comprises a laterally open recess and comprises a latch extending into the recess. Moreover, to deflect the locking hook for engaging the drop-in pin the locking hook comprises a deflecting edge extending from a free end of the locking hook and inclined in direction to the latch. To better support the locking hook it is arranged with its back end opposite to its free end on a supporting flange horizontally extending from the support bracket.

This supporting flange is also used for mounting a spring element between an end of the support bracket and the locking hook. Moreover, an end stop is arranged on the supporting flange for limiting the movement of the locking hook whereby an abutting flange limiting the recess of the locking hook opposite to the latch comes into abutment with the end stop to limit the movement of the locking hook in direction to the spring element.

Other features and advantages of the invention will be apparent for those skilled in the art from the following detailed description of a preferred embodiment, together with the accompanying drawings, in which:

DETAILED DESCRIPTION OF A PREFERRED EMBODIMENT

Figure 1:
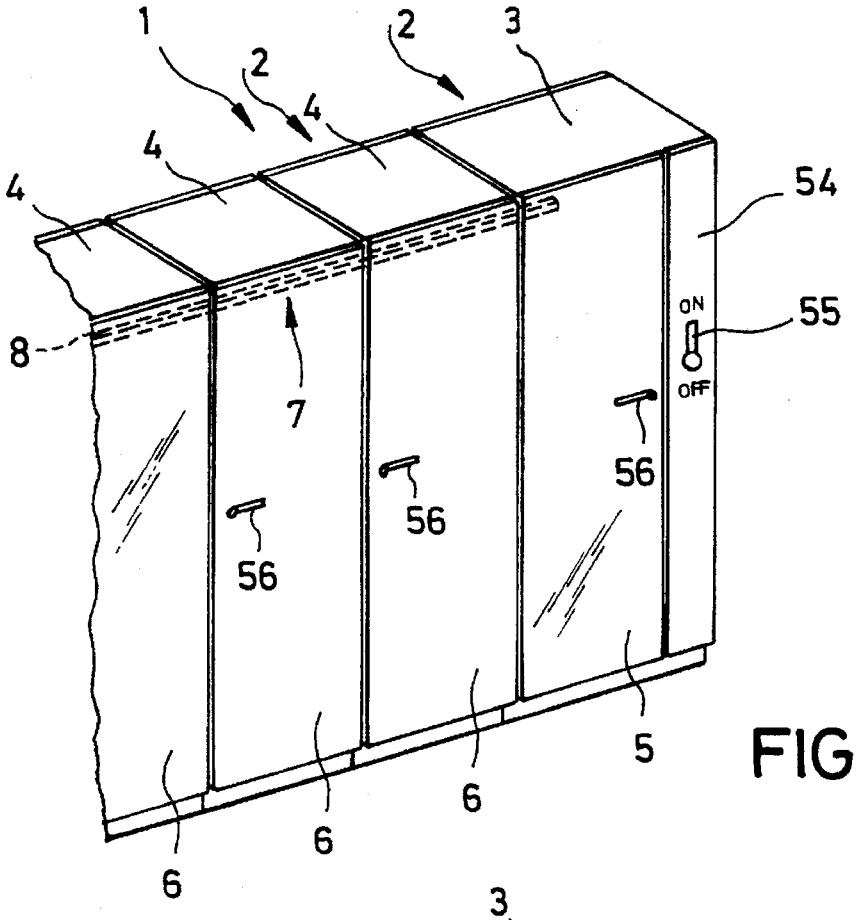
FIG. 1 is a view of a multi-cabinet assembly with closed and locked doors.

FIG. 1 illustrates a multi-cabinet assembly 1 including a number of single cabinets 2, i.e. a master cabinet 3 and three slave cabinets 4. It is noted that the number of slave cabinets may vary from one to many. The master cabinet 3 and the slave cabinets 4 are arranged side-by-side and are in direct lateral contact. The master cabinet 3 has a hinged and openable master door 5 and the slave cabinets 4 have corresponding hinged and openable slave doors 6. Each of the doors 5, 6 can be opened by operating the door handle 56.

The master cabinet 3 further comprises on its front surface a hinged and openable flange door 54 with an installed operator handle 55. The operator handle is in its ON position in FIG. 1. Accordingly, electrical and electronic equipment inside the multi-cabinet assembly are connected to a power supply.

At the upper ends of the doors 5, 6 one or a number of connected interconnecting rods 8 are slidably supported, whereby the interconnecting rod is a part of an interlock system for the slave doors.

Figure 2:
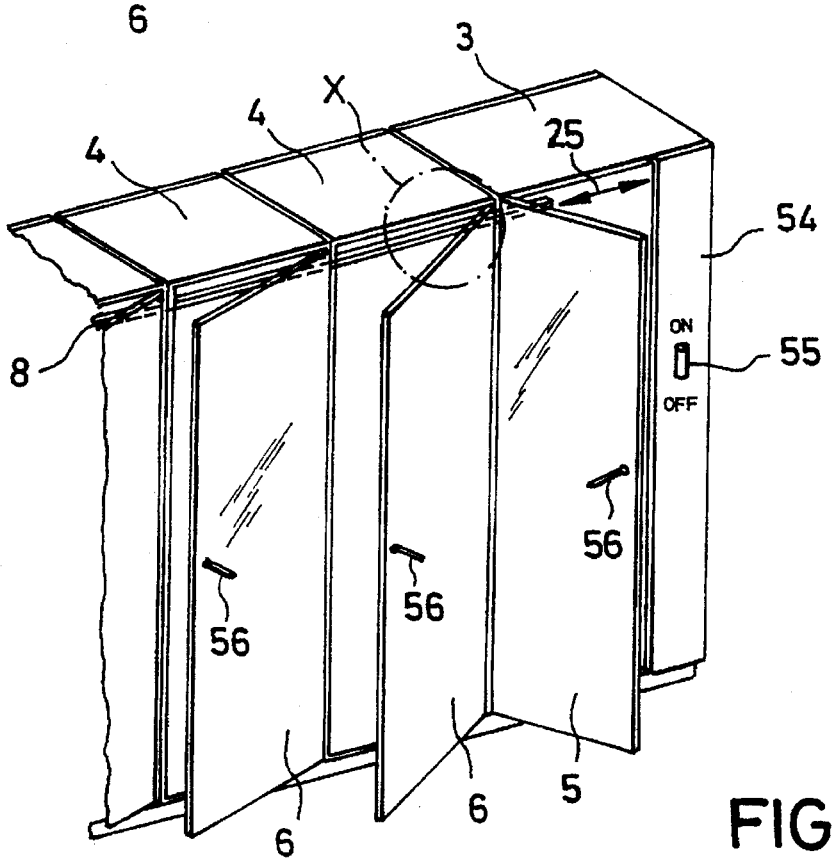
FIG. 2 is a view corresponding to FIG. 1 with unlocked and opened doors.

In FIG. 2 the operator handle 55 is in its OFF position, whereby the electric and electronic equipment inside the multi-cabinet assembly is separated from its power supply. Moreover, an interlock system for the master door movably connected to the operator handle is in its inoperative position so that the master door 5 can be opened by operating the door handle 56. By opening the master door 5 the one or the plurality of interconnecting rods 8 are pushed in sliding direction 25 for placing an interlock system for the slave doors 6 in its inoperative position so that the slave doors 6 can be opened by operating door handles 56.

Figure 3:
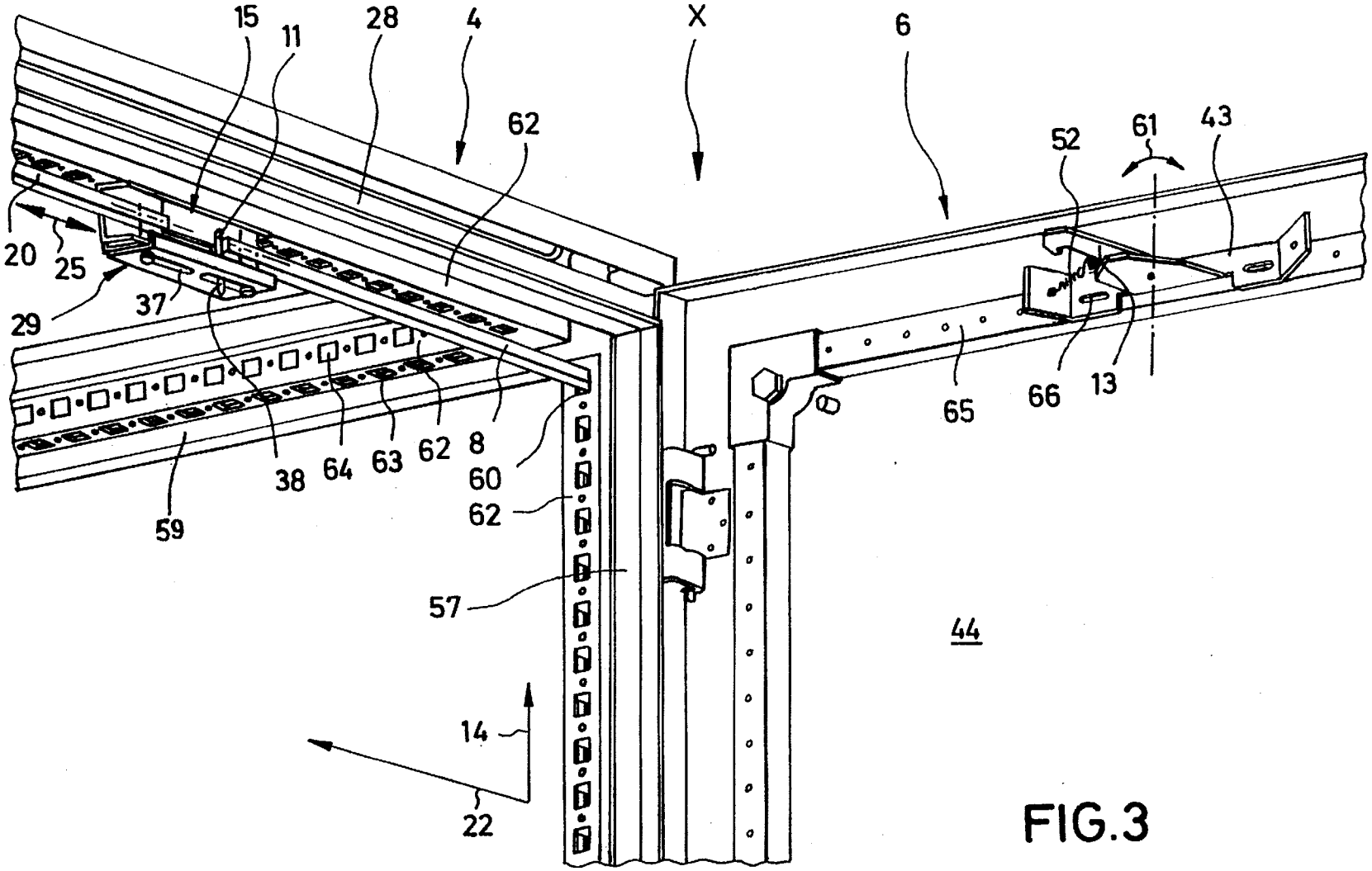
FIG. 3 is an enlarged view of section X of FIG. 2.

That part of the interlock system allocated to one slave door 6 is arranged in portion X of FIG. 2 of which FIG. 3 is an enlarged illustration. All the other parts of the interlock system allocated to all the other slave doors are of analogous construction so that the description can be limited to portion X of the interlock system.

In FIG. 3 section X of FIG. 2 is illustrated with an opened slave door 6. At an inner side 44 of the slave door 6 a cross beam 65 is mounted to which a locking hook 13 as a counterlocking means is mounted by a support bracket 43. The locking hook 13 is pivotally supported by the support bracket 43 for pivoting in direction 61. Between the locking hook and a lateral arm of the support bracket 43 a spring element 52 for spring-loading locking hook 13 is arranged. The support bracket 43 can be fixed to a cross beam 65 by screws (not illustrated) inserted in slits 66.

The slave cabinet 4 has a frame comprising a lateral frame 57, a side frame 59 and an upper frame 28. Further frame parts of the slave cabinet 4 are not described with respect to FIG. 3.

The lateral frame 57, the side frame 59 and the upper frame 28 include cross beams 62 that have openings 63 at its lower surface and further openings 64 at its back surface.

Below the cross beam 62 of the upper door frame 28 the interconnecting rod 8 and a further interconnecting rod 20 are arranged. Interconnecting rod 8 is movably connected to the master door of FIGS. 1 or 2. Moreover, interconnecting rod 8 and the further interconnecting rod 20 extending to the next slave cabinet, see FIGS. 1 or 2, are fixed to a mounting 15 which is slidably supported by a slide device 29.

Figure 5:
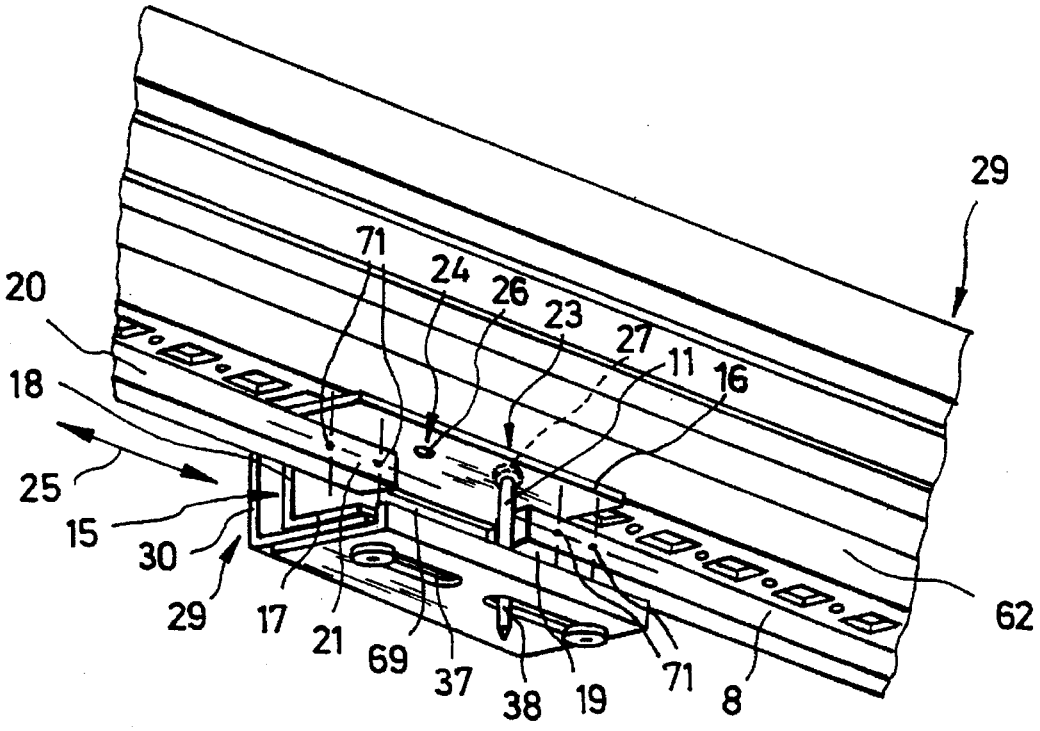
FIG. 5 is an enlarged view of a locking means with a drop-in pin of FIG. 3.

The mounting 15 has a U-shaped cross-section and will be further described with respect to FIG. 5. The slide device 29 is a slide guide of a substantially U-shaped cross-section and will be described with respect to FIG. 6.

As a locking means drop-in pin 11 is supported by mounting 15 whereby lower end 38 of the drop-in pin 11 extends below mounting 15 and is inserted in a guide slot 37 provided in a lower U-shank of slide device 29.

Slide device 29 is releasably fixed to a cross beam 62 with help of openings 64 on the backside of the cross beam.

The interconnecting rod 8 and the further interconnecting rod 20 are guided through openings 60 in the corresponding lateral frames 57.

Figure 4:
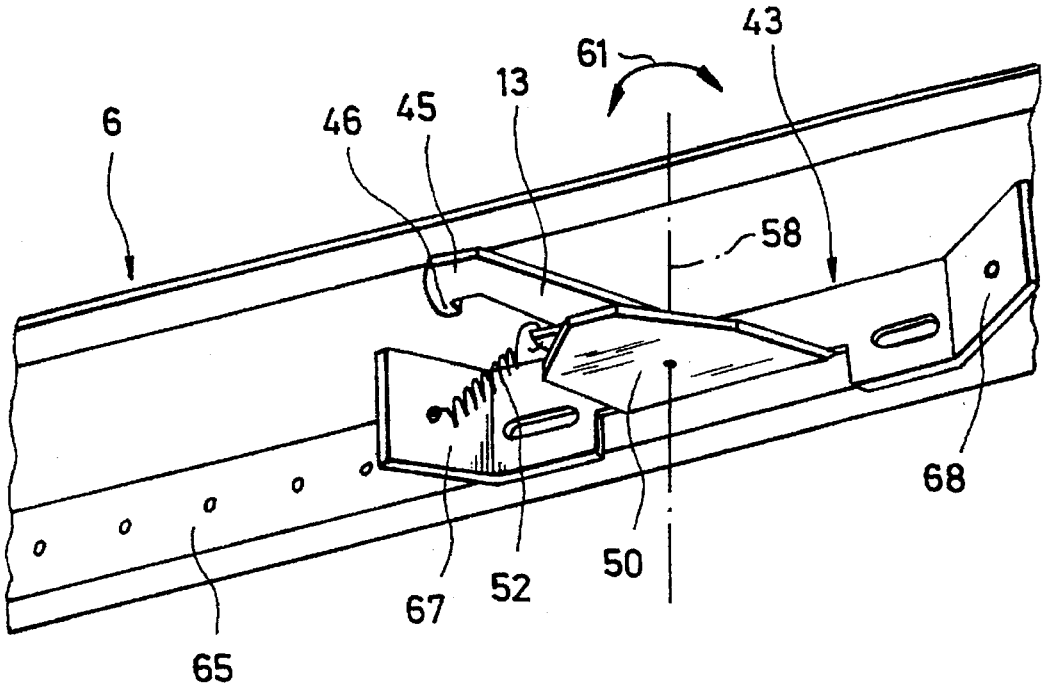
FIG. 4 is an enlarged view of a locking hook of FIG. 3.

In FIG. 4 the locking hook 13 and its mounting to cross beam 65 at the inner surface of slave door 6 are illustrated in more detail.

Locking hook 13 is made of a flat shoot of metal and comprises a latch 46 for engagement with drop-in pin 11 of FIG. 3 arranged at its free end 45 whereby the locking hook 13 is pivotally supported on supporting flange 50 extending integrally from the support bracket 43. The locking hook 13 is pivotable in direction 61 about vertical axis 58.

Support bracket 43 has two lateral arms 67 and 68 extending from cross beam 65. Between one lateral arm 67 and locking hook 13 the spring element 52 is arranged.

In FIG. 5 the drop-in pin 11, the mounting 15 and the slide device 29 are illustrated in more detail.

The drop-in pin 11 is inserted in a bearing 23 of mounting 15 which bearing comprises an upper bore 27 and a lower bore (not illustrated). The two bores are coaxially arranged. Another bearing 24 is arranged adjacent to bearing 23 and also comprises two coaxial bores. The drop-in pin 11 extends in vertical direction 14, see FIG. 3, whereby that portion of pin 11 between upper U-shank 16 and lower U-shank 17 of mounting 15 may be engaged by locking hook 13.

The two U-shanks 16 and 17 of mounting 15 extend in horizontal direction 22, see FIG. 3, and are directed to the slave door (not illustrated). The two U-shanks 16 and 17 are connected at their back ends by U-web 18 which extends parallel to drop-in pin.

The two lateral end portions of web 18 and end 19 of interconnecting rod 8 and an end 21 of the further interconnecting rod 20 are fixed to the web 18 by for example screw members 71 and corresponding nuts on the backside of web 18. The two ends 19 and 21 of the interconnecting rods 8 and 20 are spaced from one another whereby drop-in pin 11 is arranged between those ends. It should be noted that drop-in pin can for example be arranged in the other bearing 24 in case the corresponding slave door is hinged at the other lateral frame of the slave cabinet so that the slave door can be opened like master door 5 of FIG. 2.

A lower end 38 of the drop-in pin 11 extends through slide device 29 in downward direction and is guided in the guide slot 37 provided in a lower U-shank of slide device 29.

It should be further noted that the lower U-shank of slide device 29 is longer and extends further in direction to the slave door than the lower U-shank 17 of mounting 15. In contrast, upper U-shank of slide device 29 is shorter than the corresponding U-shank 16 of mounting 15. Furthermore, an opening 69 is arranged in web 18 of mounting 15 and extends in horizontal direction 22, see FIG. 3, or in sliding direction 25. This opening 69 is used for at least partially inserting free end 45 of locking hook 13, see FIG. 4, just before and during engagement of the locking hook and the drop-in pin 11.

Figure 6:
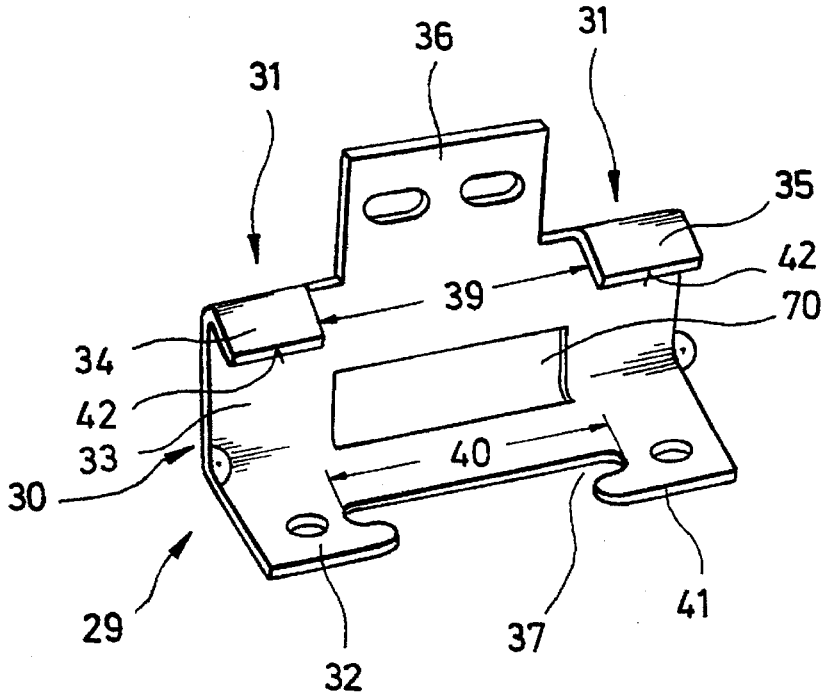
FIG. 6 is a view of a slide device for supporting a mounting with a drop-in pin as shown in FIG. 5.

In FIG. 6 the slide device 29 is illustrated. The slide device 29 is formed as a slide guide 30 comprising a lower U-shank 32, an upper U-shank 31 and a U-web 33. The upper U-shank 31 is built by two shank portions 34 and 35 arranged at the lateral ends of web 33. Between the two shank portions 34 and 35 a mounting plate 36 extends integrally from web 33 in vertical direction. The mounting plate comprises two slots for mounting a slide guide 30 to cross beam 62, see FIG. 3.

In web 33 and partially in lower U-shank 32 an opening 70 is formed which corresponds to opening 69 of mounting 15, see FIG. 5. Web 33, shank portions 34, 35 and lower shank 32 are perpendicularly arranged to one another whereby web 33 extends in vertical direction and the shanks extend in horizontal direction.

Free ends 42 of shank portions 34 are arranged backwards to guide slot 37 so that they do not cover this guide slot. Moreover, the distance 39 between the two shank portions 34 and 35 is at least as long as length 40 of guide slot 37. The guide slot 37 is arranged nearer to free end 41 of lower U-shank 32 than to web 33.

Figure 7:
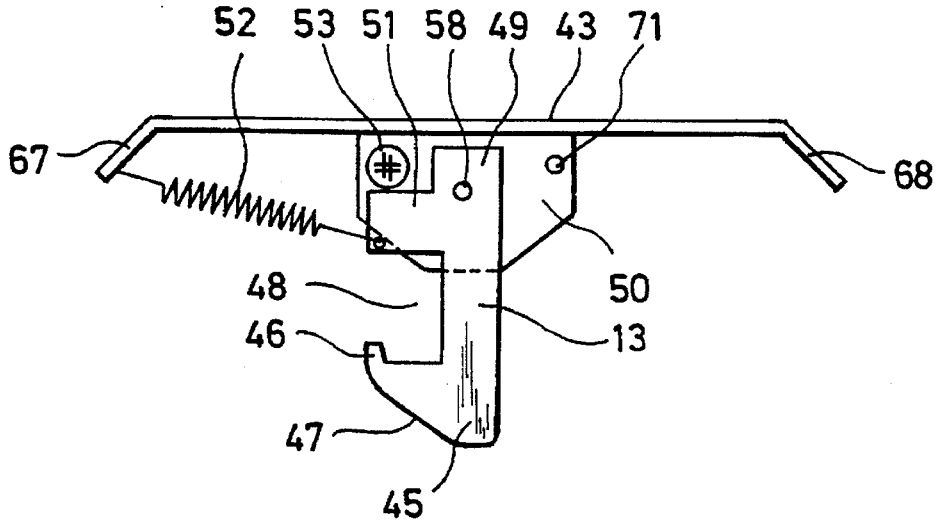
FIG. 7 is a top view of the locking hook of FIG. 4.

In FIG. 7 a top view of hook 13 according to FIG. 4 is illustrated. Same reference numerals are used for same parts and with respect to those reference numerals, it is referred to the description of FIG. 4.

The locking hook 13 has a deflecting edge 47 inclined and directed backwards from free end 45 of hook 13 to latch 46. This deflecting edge is used for deflect hook 13 when it comes in contact with drop-in pin 11, see FIG. 5, in case the slave door is closed and in case the drop-in pin is arranged in engagement position and not in release position. It should be noted that the engagement position is obtained by closing the master door and the release position is obtained by opening the master door whereby the interconnecting rod 8 is displaced correspondingly.

The locking hook 13 further comprises a recess 48 formed between latch 46 at free end 45 and an abutting flange 51. The recess 48 has essentially a rectangular form and is opened in direction to lateral arm 67 of support bracket 43. Only latch 46 extends inside recess 48 so that when drop-in pin 11, see FIG. 5, is located in recess 48 latch 46 engages it when the slave door is closed and the drop-in pin is in engagement position.

The abutting flange 51 extends towards lateral arm 67 and defines an end position of locking hook 13 in direction to lateral arm 67 by abutting against end stop 53. This end stop 53 is arranged on supporting flange 50. Supporting bracket 43 can also be used with locking hook 13 arranged with its recess 48 in opposite direction, i.e. in direction to lateral arm 68. In this case end stop 53 can be fixed in bore 71 and spring element 52 is arranged between abutting flange 51 and lateral arm 68. This kind of arrangement of locking hook 13 can be used for slave doors hinged like master door 5 of FIG. 2.

Furthermore, locking hook 13 comprises a back end 49 which extends towards support bracket 43 and which is arranged on supporting flange 50. Back end 49 is used to mount locking hook 13 for pivotal movements about vertical axis 58.

A very secure interlocking system of simple construction has thus been described which provides a secure locking of the slave doors. Since numerous modifications and variations will occur to those skilled in the art, it is intended that the invention be limited only in terms of the appended claims.

What is claimed is:

1. Multi-cabinet assembly comprising single cabinets arranged next to one another, the single cabinets including at least one master cabinet and one slave cabinet each having a door, said multi-cabinet assembly further comprising an interlock system for the slave doors including at least one horizontally movable interconnecting rod, a locking means connected to the interconnecting rod for being displaced between an engagement position and a release position, and a counterlocking means for engaging said locking means in a closed position of the slave door when said locking means is in said engagement position, the counterlocking means being arranged at the slave door and said interconnecting rod being movably connected with the master door for displacing the locking means, said locking means essentially extending in a vertical direction and said counterlocking means including a locking hook which is pivotable about a vertical axis and is spring-loaded towards the locking means for mutual engagement therewith.

2. Multi-cabinet assembly according to claim 1, wherein said locking means is an essentially vertical drop-in pin.

3. Multi-cabinet assembly according to claim 2, wherein said drop-in pin is supported by a mounting fixed to said interconnecting rod.

4. Multi-cabinet assembly according to claim 3, wherein said mounting is of an essentially U-shaped cross-section whereby said drop-in pin is bilaterally supported by U-shanks of the mounting directed to said slave door.

5. Multi-cabinet assembly according to claim 4, wherein said U-shanks are essentially horizontally arranged and comprise an upper and a lower U-shank.

6. Multi-cabinet assembly according to claim 4, wherein said interconnecting rod is fixed to a U-web connecting both of said U-shanks.

7. Multi-cabinet assembly according to claim 6, including a further interconnecting rod, and wherein one end of the interconnecting rod movably connected with the master door and one end of the further interconnecting rod are fixed to said U-web, the further interconnecting rod extending to a further slave cabinet.

8. Multi-cabinet assembly according to claim 7, wherein the ends of said interconnecting rods are fixed to the U-web, said ends being spaced in horizontal direction, and wherein said drop-in pin is supported between the ends.

9. Multi-cabinet assembly according to claim 2, including at least two bearings for the drop-in pin arranged in both U-shanks.

10. Multi-cabinet assembly according to claim 9, wherein said bearings are spaced from one another in sliding direction of said interconnecting rod.

11. Multi-cabinet assembly according to claim 10, wherein each bearing comprises two bearing bores coaxially arranged in the lower and upper U-shanks.

12. Multi-cabinet assembly according to claim 11, wherein said drop-in pin is releasably inserted in both bearing bores and wherein said drop-in pin comprises a head at its upper end supported on the upper U-shank.

13. Multi-cabinet assembly according to claim 10, wherein an opening is formed in said U-web for partially inserting the locking hook.

14. Multi-cabinet assembly according to claim 3, including a slide device arranged at an upper frame member of the slave cabinet, and wherein said mounting is movably supported in a sliding direction by the slide device.

15. Multi-cabinet assembly according to claim 14, wherein the mounting has an essentially U-shaped cross-section and includes upper and lower U-shanks, and wherein said slide device is a slide guide having an essentially U-shaped cross-section releasably mounted to said upper frame member whereby upper and lower U-shanks of the slide guide at least partially embrace said U-shanks of said mounting.

16. Multi-cabinet assembly according to claim 15, wherein said mounting and said slide guide each include a U-web from which the respective U-shanks extend, and wherein said U-web of said mounting is spaced from the U-web of the slide guide and said lower U-shank of said slide guide extends further than said lower U-shank of said mounting in the direction of the slave door.

17. Multi-cabinet assembly according to claim 15, wherein said slide guide includes a U-web from which the U-shanks extend, and wherein said upper U-shank of said slide guide comprises two shank sections arranged at end portions of the U-web and including an essentially vertical mounting plate extending from said U-web between said shank sections.

18. Multi-cabinet assembly according to claim 17, wherein said upper shank sections of said slide guide are shorter than said upper shank of said mounting.

19. Multi-cabinet assembly according to claim 18, including a guide slot for guiding a lower end of said drop-in pin arranged in said lower U-shank of the slide guide.

20. Multi-cabinet assembly according to claim 19, wherein said guide slot has a length approximately equal to the distance between the upper shank sections.

21. Multi-cabinet assembly according to claim 19, wherein said guide slot is arranged adjacent to a free end of said lower U-shank of the slide guide and is arranged in front of free ends of said upper shank sections in the direction to the slave door.

22. Multi-cabinet assembly according to claim 1, including a support bracket releasably mounted to an inner surface of said slave door for supporting said locking hook.

23. Multi-cabinet assembly according to claim 22, wherein said locking hook is manufactured from a flat sheet metal.

24. Multi-cabinet assembly according to claim 23, wherein said locking hook comprises a latch and a deflecting edge extending from a free end of the locking hook and inclined in a direction towards the latch.

25. Multi-cabinet assembly according to claim 24, wherein said latch extends into a laterally open recess defined by said locking hook.

26. Multi-cabinet assembly according to claim 23, including a supporting flange horizontally extending from said support bracket, and wherein said locking hook is arranged with a back end opposite to said free end and is pivotally supported by the supporting flange.

27. Multi-cabinet assembly according to claim 26, including an abutting flange defining a portion of said recess opposite to said latch and a spring element arranged between said abutting flange and said support bracket.

28. Multi-cabinet assembly according to claim 27, including an end stop for abutment with the abutting flange of the locking hook arranged at the supporting flange of the support bracket on the side of the spring element.

29. A cabinet assembly comprising a plurality of adjacent cabinet doors arranged one next to another, the cabinet assembly comprising a master door and at least one slave door, an interlock system controllable with the master door for locking and unlocking the slave doors, the interlock system including a horizontally reciprocable connecting rod operatively coupled with the master door for substantially horizontal movement of the rod into and out of a locking position when the master door is in a closed and open position, respectively; locking means carried by the rod and including a substantially vertically extending member for movement of the locking means between locked and unlocked positions; and counterlocking means coupled to each slave door and comprising a locking hook, means permitting pivotal movements of the locking hook about a vertical axis, and a spring biasing the locking hook into engagement with the locking means when the locking means is in its locking position so that an opening or closing of the master door moves the rod in one and another direction to thereby engage or disengage, respectively, the locking means from the locking hook of the counterlocking means.

* * * * *